US006349531B1

(12) United States Patent
Kolmes et al.

(10) Patent No.: US 6,349,531 B1
(45) Date of Patent: Feb. 26, 2002

(54) MULTIPART COMPONENT FOR A CUT RESISTANT COMPOSITE YARN AND METHOD OF MAKING

(75) Inventors: Nathaniel H. Kolmes; Danny Ray Benfield; Della Bonell Moore, all of Hickory; George Marion Morman, Jr., Moravian Fallls; Richie Darnell Phillips; Eric Pritchard, both of Hickory, all of NC (US)

(73) Assignee: Supreme Elastic Corporation, Conover, NC (US)

( * ) Notice: Subject to any disclaimer, the term of this patent is extended or adjusted under 35 U.S.C. 154(b) by 0 days.

(21) Appl. No.: 09/332,245

(22) Filed: May 13, 1999

(51) Int. Cl.[7] ..... D02G 3/18
(52) U.S. Cl. ..... 57/229; 57/230
(58) Field of Search ..... 57/210, 229, 230, 57/231, 308, 350, 246, 243; 2/167

(56) References Cited

U.S. PATENT DOCUMENTS

| | | | | |
|---|---|---|---|---|
| 3,972,174 A | | 8/1976 | London, Jr. et al. | 57/140 |
| 4,086,751 A | | 5/1978 | Hino et al. | 57/157 |
| 4,395,871 A | | 8/1983 | Smid et al. | 57/286 |
| 4,464,894 A | | 8/1984 | Leininger | 57/288 |
| 4,499,717 A | | 2/1985 | Dimitrov | 57/297 |
| 4,545,835 A | | 10/1985 | Gusack et al. | 156/180 |
| 4,934,134 A | | 6/1990 | Neiderer | 57/350 |
| 4,936,085 A | * | 6/1990 | Kolmes et al. | 57/229 |
| 5,119,512 A | | 6/1992 | Dunbar et al. | 2/167 |
| 5,146,660 A | | 9/1992 | Ritter | 28/274 |
| 5,177,948 A | | 1/1993 | Kolmes et al. | 57/229 |
| 5,275,618 A | | 1/1994 | Koyfman et al. | 606/228 |
| 5,518,814 A | | 5/1996 | Bonigk | 428/365 |
| 5,549,966 A | | 8/1996 | Sassa | 428/229 |
| 5,579,628 A | | 12/1996 | Dunbar et al. | 57/246 |
| 5,597,649 A | | 1/1997 | Sandor et al. | 428/370 |
| 5,628,172 A | | 5/1997 | Kolmes et al. | 57/210 |
| 5,644,909 A | | 7/1997 | Knoff et al. | 57/293 |
| 5,713,113 A | | 2/1998 | Demir | 28/274 |
| 5,746,046 A | | 5/1998 | McCartner et al. | 57/350 |
| 5,845,476 A | | 12/1998 | Kolmes | 57/229 |

* cited by examiner

*Primary Examiner*—Danny Worrell
(74) *Attorney, Agent, or Firm*—Womble Carlyle Sandridge & Rice, PLLC; C. Robert Rhodes

(57) ABSTRACT

A non-metallic multipart yarn component for use in combination with other yarn strands to make a cut resistant composite yarn. The multipart yarn component includes at least one non-metallic strand comprised of an inherently cut-resistant material and at least one non-metallic strand comprised of a non-cut resistant material. The two strands are air interlaced with each other so as to form attachment points intermittently along the lengths of the strands. At least one or the other of the strands is a multi filament strand. The invention may further include at least one cover strand wrapped about the air interlaced cut resistant and non-cut resistant strands in a first direction. A second cover strand may be provided wrapped about the first cover strand in a second direction opposite that of the first cover strand.

35 Claims, 2 Drawing Sheets

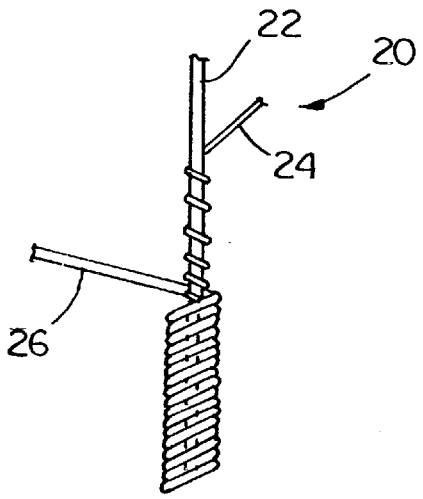
FIG. 2
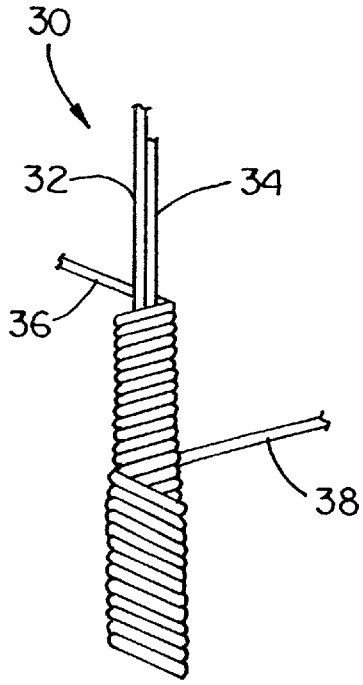
FIG. 3
FIG. 5
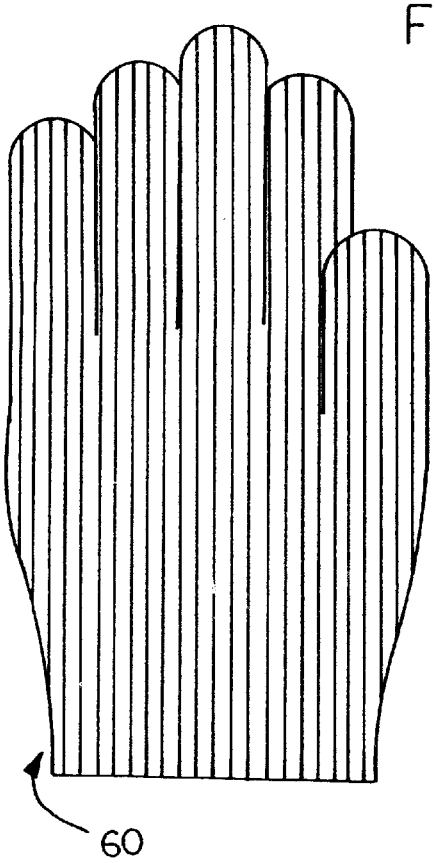
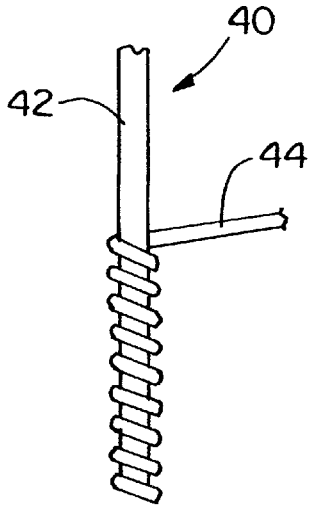
FIG. 4

MULTIPART COMPONENT FOR A CUT RESISTANT COMPOSITE YARN AND METHOD OF MAKING

FIELD OF THE INVENTION

The present invention relates to the field of non-metallic cut and abrasion resistant composite yarns, and, more particularly to the application of air intermingling technology to the manufacture of such yarns.

BACKGROUND OF THE INVENTION

The present invention relates to composite yarns useful in the manufacture of various types of protective garments such as cut and puncture resistant gloves, aprons, and glove liners. It is well-known in the art to manufacture such composite yarns by combining yarns constructed of non-metallic, inherently cut-resistant materials using wrapping techniques. For example, these yarns may use a core construction comprising one or more strands that may be laid in parallel relationship or, alternatively, may include a first core strand that is overwrapped with one or more additional core strands. A representative sample of such yarns includes those disclosed in U.S. Pat. Nos. 5,177,948; 5,628,172; 5,845,476; and 5,119,512. The composite yarns described above can be knit on standard glove-making machines with the choice of machine being dependent, in part, on the size of the yarn.

Wrapping techniques are expensive because they are relatively slow and often require that separate wrapping steps be made on separate machines with intermediate wind up steps. Further, those techniques require an increased amount of yarn per unit length of finished product depending on the number of turns per inch used in the wrap. Generally, the greater the number of turns per inch, the greater the expense associated with making the composite yarn. When the yarn being wrapped is high performance fiber, this cost may be high.

Knitted gloves constructed using a relatively high percentage of high performance fibers do not exhibit a soft hand and tend to be stiff. This characteristic is believed to result from the inherent stiffness of the high performance fibers. It follows that the tactile response and feedback for the wearer is reduced. Because these gloves typically are used in meat-cutting operations around sharp blades, it would be desirable to maximize these qualities in a cut-resistant glove.

It is well-known in the textile art to create textured yarns using a variety of texturing processes. The term "texturing" refers generally to a process of crimping, imparting random loops, or otherwise modifying continuous filament yarn to increase its cover, resilience, warmth, insulation, and/or moisture absorption. Further, texturing may provide a different surface texture to achieve decorative effects. One well-known texturing method is the air-jet method. Generally, this method involves leading yarn through a turbulent region of an air-jet at a rate faster than it is drawn off on the exit side of the jet. In one approach, the yarn structure is open by the air-jet, loops are formed therein, and the structure is closed again on exiting the jet. Some loops may be locked inside the yarn and others may be locked on the surface of the yarn depending on a variety of process conditions and the structure of the air-jet texturizing equipment used. A typical air-jet texturizing devices and processes is disclosed in U.S. Pat. 3,972,174.

Another type of air jet treatment has been used to compact multifilament yarns to improve their processibility. Flat multifilament yarns are subjected to a number of stresses during weaving operations. These stresses can destroy interfilament cohesion and can cause filament breakages. These breakages can lead to costly broken ends. Increasing interfilament cohesion has been addressed in the past by the use of adhesives such as sizes. However, air compaction has enabled textiles processors to avoid the cost and additional processing difficulties associated with the use of sizes. The use of air compaction for high strength and non-high strength yarns is disclosed in U.S. Pat. 5,579,628 and 5,518,814. The end product of these processes typically exhibits some amount of twist.

It would be desirable to combine cut-resistant and non-cut-resistant yarn strands using a different, less expensive technique to create a single combined strand. Desirably, this technique would avoid the expense and time required to use the wrap approaches known in the art.

SUMMARY OF THE INVENTION

The present invention addresses the problems described with known cut-resistant, composite yarns by providing a novel means of combining a strand comprised of a cut resistant material and a strand comprised of a non-cut resistant material. The use of some type of air jet device to air interlace these two types of materials produces a composite yarn and a glove having surprising softness, hand and tactile response. The invention permits one of ordinary skill to take advantage of the ability of either a fiberglass or acrylic strand to provide support for a high performance fiber without the need for expensive wrapping techniques. The air interlacing approach permits several strands of both cut resistant and non-cut resistant materials to be combined in a number of different combinations depending on the materials available and the desired characteristics of the finished product. This combination can be achieved using fewer manufacturing steps than would be required with the techniques applied thus far to the preparation composite, cut resistant yarns.

In one embodiment the invention relates to A non-metallic multipart yarn component for use in combination with other yarn strands to make a cut resistant composite yarn including at least one strand comprised of a cut resistant material and at least one fiberglass strand. Alternatively, the yarn component may be comprised of at least one strand of a cut resistant material and at least one strand of a non-cut resistant material. The two strands are air interlaced with each other to form a single combined strand having attachment points intermittently along the length of the single combined strand. One or the other of the cut resistant or fiberglass strands is a multifilament strand. The invention may further include a first cover strand wrapped about the single combined strand in a first direction. A second cover strand may be provided wrapped about the first cover strand in a second direction opposite that of the first cover strand.

The invention further relates to a method of making a non-metallic cut resistant composite yarn including the steps of feeding a plurality of yarn strands into a yarn air texturizing device wherein the plurality of strands includes (i) at least one non-metallic strand comprised of an inherently cut resistant material and (ii) at least one non-metallic strand comprised of a non-cut resistant material.

The method further includes air interlacing the plurality of yarn strands so as to form attachment points intermittently along the lengths of the strands. At least one of the plurality of yarn strands is a multi filament strand. The plurality of strands may include both fiberglass and non-fiberglass strands.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed. The accompanying drawings, which are incorporated in and constitute a part of this specification, illustrate one embodiment of the invention and, together with the description, serve to explain the principles of the invention.

BRIEF DESCRIPTION OF THE DRAWINGS

The above and other objects, features, and advantages of the present invention will be more clearly understood from the following detailed description taken in conjunction with the accompanying drawings, in which:

FIG. 2 is an illustration of a preferred embodiment of a composite yarn in accordance with the principles of the present invention having a single core strand and two cover strands;

FIG. 3 is an illustration of an alternative embodiment of a composite yarn in accordance with the principles of the present invention having two sore strands and two cover strands;

FIG. 4 is an illustration of an alternative embodiment of a composite yarn in accordance with the principles of the present invention having a single core strand and a single cover strand; and FIG. 5 is an illustration of a protective garment, namely a glove, in accordance with the principles of the present invention.

DETAILED DESCRIPTION OF PREFERRED EMBODIMENT

Figure 1:
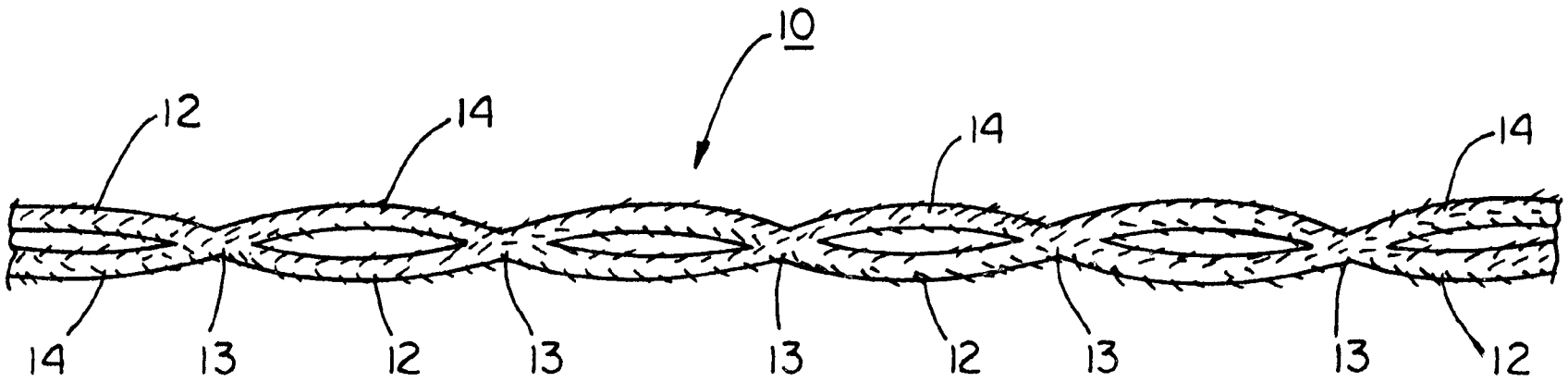
FIG. 1 is a schematic representation of the structure of the multi-part yarn component of the present invention.

The term "fiber" as used herein refers to a fundamental component used in the assembly of yarns and fabrics. Generally, a fiber is a component which has a length dimension which is much greater than its diameter or width. This term includes ribbon, strip, staple, and other forms of chopped, cut or discontinuous fiber and the like having a regular or irregular cross section. "Fiber" also includes a plurality of any one of the above or a combination of the above.

As used herein, the term "high performance fiber" means that class of fibers having high values of tenacity such that they lend themselves for applications where high abrasion and/or cut resistance is important. Typically, high performance fibers have a very high degree of molecular orientation and crystallinity in the final fiber structure.

The term "filament" as used herein refers to a fiber of indefinite or extreme length such as found naturally in silk. This term also refers to manufactured fibers produced by, among other things, extrusion processes. Individual filaments making up a fiber may have any one of a variety of cross sections to include round, serrated or crenular, bean-shaped or others.

The term "yarn" as used herein refers to a continuous strand of textile fibers, filaments or material in a form suitable for knitting, weaving, or otherwise intertwining to form a textile fabric. Yarn can occur in a variety of forms to include a spun yarn consisting of staple fibers usually bound together by twist; a multi filament yarn consisting of many continuous filaments or strands; or a mono filament yarn which consist of a single strand.

The term "air interlacing" as used herein refers to subjecting multiple strands of yarn to an air jet to combine the strands and thus form a single, intermittently commingled strand. This treatment is sometimes referred to as "air tacking." This term is not used to refer to the process of "intermingling" or "entangling" which is understood in the art to refer to a method of air compacting a multifilament yarn to facilitate its further processing, particularly in weaving processes. A yarn strand that has been intermingled typically is not combined with another yarn. Rather, the individual multifilament strands are entangled with each other within the confines of the single strand. This air compacting is used as a substitute for yarn sizing and as a means to provide improved pick resistance. This term also does not refer to well known air texturizing performed to increase the bulk of single yarn or multiple yarn strands.

A multi-part yarn component 10 according to the present invention is illustrated schematically in FIG. 1. The yarn component can be used in combination with other yarn strands to make a cut resistant composite yarn and includes at least one strand 12 comprised of an inherently cut resistant material and at least one strand 14 comprised of a non-cut resistant material. The cut resistant and non-cut resistant strands 12,14 are interlaced with each other so as to form attachment points 13 intermittently along the lengths of the single combined strand 10. Desirably, one or the other of the strands 12, 14 is a multi-filament strand. The strands 12, 14 may be air interlaced using well-known devices devised for that purpose. A suitable device includes the SlideJet-FT system with vortex chamber available from Heberlein Fiber Technology, Inc.

This device will accept multiple running multi filament yarns and expose the yarns to a plurality of air streams such that the filaments of the yarns are uniformly intertwined with each other over the length of the yarn. This treatment also causes intermittent interlacing of the yarn strands to form attachment points between the yarn strands along their lengths. These attachment points have a length of between about 0.125 and about 0.375 inch depending on the texturizing equipment and yarn strand combination used. The number of yarn strands per unit length of a combined interlaced strand will very depending on variables such as the number and composition of the yarn strands fed into the device. The practice of the present invention does not include the use of yarn overfeed into the air interlacing device. The air pressure fed into the air interlacing device should not be so high as to destroy the structure of any spun yarn used in the practice of the present invention.

The yarn component illustrated in FIG. 1 may be used alone or may be combined with other strands to create a variety of composite yarn structures. In the preferred embodiment depicted in FIG. 2, the composite yarn 20 includes an air-interlaced core strand 22 overwrapped with a first cover strand 24. The cover strand 24 is wrapped in a first direction about the core strand 22. A second cover strand 26 is overwrapped about the first core strand 24 in a direction opposite to that of the first core strand 24. Either of the first cover strand 24 or second cover strand 26 may be wrapped at a rate between about 3 to 16 turns per inch with a rate between about 8 and 14 turns per inch being preferred. The number of turns per inch selected for a particular composite yarn will depend on a variety of factors including, but not limited to, the composition and denier of the strands, the type of winding equipment that will be used to make the composite yarn, and the end use of the articles made from the composite yarn.

Turning to FIG. 3, an alternative composite yarn 30 includes a first core strand 32 which is an air-interlaced strand laid parallel with a second core strand 34. This two-strand core structure is overwrapped with a first cover 36 in a first direction. Alternatively, the composite yarn 30 may include a second cover strand 38 overwrapped about the first cover strand 36 in a direction opposite to that of the first cover strand 36. The selection of the turns per inch for each of the first and second cover strands 36, 38 may be selected using the same criteria described for the composite yarn illustrated in FIG. 2.

An alternative embodiment 40 is illustrated in FIG. 4. This embodiment includes an interlaced core strand 42 which has been wrapped with a single cover strand 44. This cover strand is wrapped about the core at a rate between about 8 and 16 turns per inch. The rate will vary depending on the denier of the core and cover strands and the material from which they are constructed. It will be readily apparent that a large number of core cover combinations may be made depending on the yarn available, the characteristics desired in the finished goods, and the processing equipment available. For example, more than two strands may be provided in the core construction and more than two cover strands can be provided.

The inherently cut resistant strand 12 illustrated in FIG. 1 may be constructed from any high performance fiber well known in the art. These fibers include, but are not limited to an extended-chain polyethylene (sometimes referred to as "ultrahigh molecular weight polyethylene"), preferably Spectra® fiber manufactured by Allied Signal; an Aramid, such as Kevlar® fiber manufactured by DuPont De Nemours; and a liquid crystal polymer fiber such as Vectran® fiber manufactured by Hoescht Celanese. Another suitable inherently cut resistant fiber includes Certran® M available from Hoescht Celanese. These and other cut resistant fibers may be supplied in either continuous multi-filament form or as a spun yarn. Generally, it is believed that these yarns may exhibit better cut resistance when used in continuous, multi-filament form.

The denier of the inherently cut resistant strand used to make the multi-part yarn component 10 may be any of the commercially available deniers within the range between about 70 and 1200, with a denier between about 200 and 700 being preferred.

The non-cut resistant strand 14 may be constructed from one of a variety of available natural and man made fibers. These include polyester, nylon, acetate, rayon, cotton, polyester-cotton blends. The manmade fibers in this group may be supplied in either continuous, multi-filament form or in spun form. The denier of these yarns may be any one of the commercially available sizes between about 70 and 1200 denier, with a denier between about 140 and 300 being preferred and a denier.

The cover strands in the embodiments depicted in FIGS. 2–4 above may be comprised of either an inherently cut resistant material or a non-cut resistant material or combinations thereof depending on the particular application. For example in the embodiments having two cover strands, the first cover strand may be comprised of an inherently cut resistant material and the second cover strand may be comprised of a non-cut resistant material such as nylon or polyester. This arrangement permits the yarn to be dyed or to make a yarn that will create particular hand characteristics in a finished article.

A fiberglass strand or strands may be included in the multipart yarn component as one of the non cut-resistant strands. The fiberglass may be either E-glass or S-glass of either continuous filament or spun construction. The practice of the present invention contemplates using several different sizes of commonly available fiberglass strands, as illustrated in Table 1 below:

TABLE 1

Standard Fiberglass Sizes

| Fiberglass Size | Approximate Denier |
|---|---|
| G-450 | 99.21 |
| D-225 | 198.0 |
| G-150 | 297.6 |
| G-75 | 595.27 |
| G-50 | 892.90 |
| G-37 | 1206.62 |

The size designations in the Table are well known in the art to specify fiberglass strands. These fiberglass strands may be used singly or in combination depending on the particular application for the finished article. By way of non-limiting example, if a total denier of about 200 is desired for the fiberglass component of the core, either a single D-225 or two G-450 strands may be used. Suitable fiberglass strands are available from Owens-Corning and from PPG Industries.

Table 2 below illustrates exemplary combinations of cut resistant and non-cut resistant yarns joined by an air intermingling process. Each of the examples in Table 2 was prepared using the Heberlein SlideJet-FT 15 using a P312 head. The SlideJet unit is supplied air at a pressure between about 30 and 80 psi, with an air pressure between about 40 and 50 psi being preferred. Preferably, the air supply has an oil content less than 2 ppm, and desirably, is oil-free. The terminology "_X" in the description of the yarn components refers to the number of strands of a particular component used to create a particular example. The "Comments" column shows the approximate size knitting machine on which a particular example may be knitted. It will be readily understood that two smaller sized yarn strands from Table 2 below may be feed in tandem to a knitting machine in place of a larger yarn.

TABLE 2

Interlaced Yarn Embodiments

| Exp | No. Strands | Yarn Components | Comments |
|---|---|---|---|
| 1 | 5 | 225 Fiberglass<br>375 denier Spectra fiber<br>3 × 36/1 Spun Polyester (148 denier) | 7 gauge knitting machine |
| 2 | 4 | 225 Fiberglass<br>375 denier Spectra fiber<br>2 × 36/1 Polyester (148 denier) | 7 gauge knitting machine |
| 3 | 3 | 225 Fiberglass<br>375 denier Spectra fiber<br>1 × 36/1 Polyester (148 denier) | 7 gauge knitting machine |
| 4 | 3 | 450 Fiberglass<br>200 denier Spectra fiber<br>1 × 70/1 Textured Polyester (148 denier) | 10–13 gauge knitting machine |
| 5 | 3 | 225 Fiberglass<br>375 denier Spectra fiber<br>1 × Textured Polyester (150 denier) | 10–13 gauge knitting machine |
| 6 | 4 | 225 Fiberglass<br>375 denier Spectra fiber | 13 gauge knitting machine |

TABLE 2-continued

Interlaced Yarn Embodiments

| Exp | No. Strands | Yarn Components | Comments |
|---|---|---|---|
| 7 | 4 | 2 × Textured Polyester (150 denier)<br>225 Fiberglass<br>650 denier Spectra fiber<br>2 × Textured Polyester (150 denier) | 10–13 gauge knitting machine |

Each of the embodiments illustrated above includes at least one cut-resistant strand, at least one fiberglass strand and at least one additional non-fiberglass strand. The fiberglass strand provides a cushioning effect that enhances the cut resistance of the high performance fiver.Advantageously, this effect is achieved without the time and expense of wrapping the high performance fiber around the fiberglass strands.

It has been observed that the air stream used to interlace the individual composite yarn components do not damage the fiberglass strands in the examples above. The fiberglass strands break under the force of the impinging air stream without the presence of the additional non-fiberglass strand or strands which promote the interlacing action. Typically, the brittle fiberglass strands have been used in parallel with other strands but without any engagement between the fiberglass strands and the other strand. It should also be noted that fiberglass has not been used successfully as a wrap strand. This is because the brittle glass fiber cannot undergo the bending experienced in known glove making equipment without first being wrapped or somehow protected with another yarn. The present invention offers a cost saving method for incorporating a fiberglass strand into a composite yarn structure without the need for such protection.

The following examples demonstrate the variety of the composite yarns that may be constructed using the interlaced, multipart yarn components of Table 2. The interlaced yarn component is used as a core strand in each example. The specific composite yarn components illustrate the invention in an exemplary fashion and should not be construed as limiting the scope of the invention.

TABLE 3

Composite Yarn Examples

| Exp | Interlaced Strand Core | First Cover | Second Cover |
|---|---|---|---|
| 8 | Exp 4 | Poly 150 den | Poly 150 den |
| 8A | Exp 4 | Poly 70 den | Poly 150 den |
| 9 | Exp 5 | Poly 70 den | Poly 70 den |
| 9A | Exp 5 | Spectra 200 den | Nylon 840 den |
| 10 | Exp 6 | Spectra 200 den | Spectra 200 den |
| 10A | Exp 6 | Spectra 375 den | Nylon 500 den |
| 11 | Exp 7 | Spectra 650 den | Spectra 650 den |
| 11A | Exp 7 | Spectra 375 den | Spectra 1000 den |

TABLE 3-continued

Composite Yarn Examples

| Exp | Interlaced Strand Core | First Cover | Second Cover |
|---|---|---|---|
| 12 | Exp 5 | Spectra 375 den | Cotton 5/1 den |
| 12A | Exp 5 | Spectra 200 den | Spectra 200 den |
| 13 | Exp 2 | Poly 36/1 spun | Poly 36/1 spun |
| 13A | Exp 2 | Poly 150 den | Poly 150 den |
| 14 | Exp 3 | Nylon 70 den | Nylon 70 den |
| 14A | Exp 3 | Nylon 840 den | Nylon 840 den |

In each of examples 8–14A an additional core strand may be incorporated into the yarn structure. The selection of the material and size of the second core strand will vary depending on the characteristics desired in the finished composite yarn. Suitable strands include, but are not limited to any strand known for use in the coreoa cut-resistant composite yarn.

The air interlaced yarn of the present invention may be created without using a fiberglass strand. Table 4 below illustrates additional embodiments of the air interlaced yarn that have been created using this approach:

TABLE 4

Interlaced Yarn Embodiments

| Exp | No. Strands | Yarn Components | Comments |
|---|---|---|---|
| 15 | 3 | 375 denier Spectra fiber<br>2 × 28/1 Acrylic (189.9 denier) | 7 gauge knitting machine |
| 16 | 3 | 650 denier Spectra fiber<br>2 × 20/1 Spun Polyester (265.7 denier) | 7 gauge knitting machine |
| 17 | 3 | 650 denier Spectra fiber<br>2 × 150 Textured Polyester (150 denier) | 7 gauge knitting machine |

In example 15 the acrylic strands perform the same function as that of the fiberglass strand in the examples in Table 2. Like the fiberglass, the acrylic provides a soft support surface for the high performance fiber thus making it more difficult to cut the high performance fiber. However, unlike the fiberglass, the acrylic and polyester components are not brittle and stand up to the interlacing air stream without damage.

Each of the Table 4 examples may be provided with a single strand or multiple-stand cover in similar fashion to the examples given in Table 3. In a preferred embodiment the multiple strand cover includes a bottom or first cover strand comprised of a 650 denier Spectra fiber and a top or second cover strand comprised of a 1000 denier polyester strand. Other cover strand arrangements may be used depending on the end use application of the yarn and the desired characteristics for the completed yarn.

Turning now to FIG. 5, a glove 60 constructed according to the present invention is illustrated. Surprisingly, it has been found that knit gloves incorporating the interlaced yarn of the present are more flexible and provide better tactile response to the wearer while providing similar levels of cut resistance performance. This unexpected performance is believed to stem from the fact that the air interlacing approach eliminates a wrapping step that may add stiffens to the finished composite yarn. Tables 5 and 6 below compare gloves made with the yarn of the present invention (Glove I) to a glove made using the overwrapping technique (Glove II). Table 4 describes the composite yarn construction used in each glove. The core of the yarn in Glove I was made using three substantially parallel strands. These core strands were wrapped with a first cover strand and a second cover strand. The core of Glove II was made using an air interlaced yarn component according to the present invention Table 5 compares the gloves based on softness, hand, and tactile response. The term "tactile response" refers to the feedback provided to the wearer when grasping and manipulating small objects. Each characteristic has been assigned a ranking of 1–5 with 1 being unacceptable and 5 being excellent.

TABLE 5

| | Glove Construction | | |
|---|---|---|---|
| | Core | Bottom Cover | Top Cover |
| Glove I | 650 den Spectra Fiber<br>150 den textured polyester<br>225 Fiberglass | 150/36 Polyester | 36/1 Spun Polyester |
| Glove II | 450 FG<br>650 den Spectra Fiber | 150/1 Polyester | 36/1 Polyester |

TABLE 6

| | Glove Comparison | | |
|---|---|---|---|
| | Softness | Hand | Tactile Response |
| Glove I | 2 | 2 | 2 |
| Glove II | 5 | 5 | 4 |

It can be seen that the interlaced yarn of the present invention provides improved performance compared to prior art gloves. This result is obtained even though the interlaced yarn is used only in the core of a composite construction and is wrapped with additional yarn strands.

In an alternative embodiment the air interlaced yarn may be used alone to fabricate a cut resistant garment. A glove was knitted on a Shima knitting machine using a yarn constructed according to the present invention. The knitability of the yarn was acceptable and it is believed that the yarn will provide acceptable cut resistance performance. However, the resulting glove had a "hairy" exterior appearance. It is believed that this result was caused by the exposed fiberglass content of the yarn. While this glove is believed to provide acceptable cut-resistance performance, customers may find the exterior appearance less than desirable. The addition of at least on cover strand will address this appearance. It is expected that embodiments such as those in Examples 15–17 will provide more acceptable results from an appearance standpoint without the need for a cover strand.

In yet another alternative embodiment, the air interlaced yarn of the present invention may be used as a wrapping strand in a composite yarn construction. These results are unexpected for those examples containing fiberglass as yarn strands made from fiberglass are believed to be unsuitable for wrapping. Use of the air intermingling technique permits the incorporation of fiberglass in a wrapping strand. Desirably, wrapping strands including fiberglass according to the present invention will be covered with an additional strand.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims and their equivalents.

We claim:

1. A non-metallic multipart yarn component for use in combination with other yarn strands to make a cut resistant composite yarn comprising:

a. at least one strand comprised of a cut resistant material;

b. at least one fiberglass strand;

c. at least one additional non-fiberglass strand d. wherein said at least one cut resistant strand said at least one fiberglass strand and said at least one additional non-fiberglass strand are air interlaced with each other to form a single combined strand and e. wherein one or the other of said cut resistant or fiberglass strands is a multifilament strand.

2. The yarn component of claim 1 further comprising a first cover strand wrapped about said single combined strand in a first direction.

3. The yarn component of claim 2 further comprising a second cover strand wrapped about said single combined strand in a second direction opposite the first direction.

4. The yarn component of claim 1 wherein said at least one additional non-fiberglass strand is comprised of a spun yarn.

5. The yarn component of claim 1 wherein said at least one additional non-fiberglass strand is comprised of a textured multifilament yarn.

6. The yarn component of claim 1 wherein said cut resistant strand has a denier between about 70 and about 1200.

7. The yarn component of claim 1 wherein said cut resistant strand has a denier between about 200 and about 700.

8. The yarn component of claim 1 wherein said fiberglass strand has a denier between about 100 and about 1200.

9. The yarn component of claim 1 wherein said fiberglass strand has a denier between about 100 and 300.

10. The yarn component of claim 1 wherein said non-cut resistant material is comprised of a material selected from the group consisting of polyester, nylon, acetate, rayon, cotton, and polyester-cotton blend.

11. The yarn component of claim 1 wherein said cut resistant material is comprised of a material selected from the group consisting of ultra high molecular weight polyethylene, aramid, and liquid crystal polymer.

12. A non-metallic multipart yarn component for use in combination with other yarn strands to make a cut resistant composite yarn comprising:

a. at least one strand comprised of a cut resistant material;

b. at least one non-fiberglass strand;

c. wherein said at least one cut resistant strand and said at least one non-fiberglass strand are air interlaced with each other to form a single combined strand and d. wherein one or the other of said cut resistant or non-fiberglass strands is a multifilament strand.

13. The yarn component of claim 12 further comprising a first cover strand wrapped about said single combined strand in a first direction.

14. The yarn component of claim 13 further comprising a second cover strand wrapped about said single combined strand in a second direction opposite the first direction.

15. The yarn component of claim 1 wherein said at least one non-fiberglass strand is comprised of a spun yarn.

16. The yarn component of claim 12 wherein said cut resistant strand has a denier between about 70 and about 1200.

17. The yarn component of claim 12 wherein said cut resistant strand has a denier between about 200 and about 700.

18. The yarn component of claim 12 wherein said non-cut resistant strand has a denier between about 70 and about 1200.

19. The yarn component of claim 12 wherein said non-cut resistant strand has a denier between about 140 and 300.

20. The yarn component of claim 12 wherein said non-cut resistant material is comprised of a material selected from the group consisting of polyester, nylon, acetate, rayon, cotton, and polyester-cotton blend.

21. The yarn component of claim 12 wherein said cut resistant material is comprised of a material selected from the group consisting of ultra high molecular weight polyethylene, aramid, and liquid crystal polymer.

22. A non-metallic, cut resistant, composite yarn comprising:

a. a multi-part first core strand including
   i. a strand comprised of a cut resistant material and having a denier between about 70 and 1200; and
   ii. a strand comprised of a non-cut resistant material and having a denier between about 70 and 1200;
   iii. wherein said cut resistant and non-cut resistant strands are air interlaced with each other so as to form attachment points intermittently along the lengths of said strands and wherein at least one of said strands is a multifilament strand; and b. at least one cover strand wrapped about said multi-part first core strand in a first direction.

23. The composite yarn of claim 22 further comprising a second core strand alongside said multipart first core strand.

24. The composite yarn of claim 22 wherein said cut resistant strand has a denier between about 200 and 700.

25. The composite yarn of claim 22 wherein said non-cut resistant strand has a denier between about 140 and 300.

26. The composite yarn of claim 22 wherein said strand comprised of a cut resistant material is comprised of a material selected from the group consisting of ultra high molecular weight polyethylene, aramids, and high strength liquid crystal polymers.

27. The composite yarn of claim 22 wherein said non-cut resistant strand is comprised of a material selected from the group consisting of polyester, cotton, polyester-cotton blend, nylon, acetate, and rayon.

28. The composite yarn of claim 22 wherein said at least one cover strand is comprised of a material selected from the group consisting of high molecular weight polyethylene, aramids, liquid crystal polymers, polyester, cotton, polyester-cotton blend, nylon, acetate, and rayon.

29. The composite yarn of claim 22 wherein said at least one cover strand is wrapped about said air interlaced cut resistant and non-cut resistant strands at between about 3 and 16 turns per inch.

30. The composite yarn of claim 22 wherein said at least one cover strand is wrapped about said air interlaced cut resistant and non-cut resistant strands at between about 8 and 14 turns per inch.

31. The composite yarn of claim 22 further comprising a second cover strand wrapped about said first cover strand in a second direction opposite that of the first cover strand.

32. The composite yarn of claim 31 wherein said second cover strand is comprised of a material selected from the group consisting of extended chain polyethylene, aramids, liquid crystal polymers, polyester, cotton, polyester-cotton blend, nylon, acetate, and rayon.

33. The composite yarn of claim 31 wherein said second cover strand is wrapped about said at least one cover strand at between about 3 and 16 turns per inch.

34. The composite of claim 31 wherein said second cover strand is wrapped about said at least one cover strand at between about 8 and 14 turns per inch.

35. A method of making a non-metallic cut resistant composite yarn comprising:

a. feeding a plurality of yarn strands into a yarn air interlacing device wherein said plurality of strands includes
   (i) at least one non-metallic strand comprised of an inherently cut resistant material,
   (ii) at least one fiberglass strand,
   (iii) at least one non-fiberglass strand comprised of a non-cut resistant material; and b. air interlacing said plurality of yarn strands so as to form attachment points intermittently along the lengths of said strands; and c. wherein at least one of said plurality of yarn strands is a multi filament strand.

* * * * *